US008251972B2

(12) United States Patent
Consolaro et al.

(10) Patent No.: US 8,251,972 B2
(45) Date of Patent: Aug. 28, 2012

(54) PERFORABLE CLOSURE FOR A CONTAINER, MOULD AND METHOD FOR CARRYING OUT SAID CLOSURE

(75) Inventors: Roberto Consolaro, Arzignano (IT); Angelo Consolaro, Arzignano (IT)

(73) Assignee: Brevetti Angela S.r.l. (IT)

( * ) Notice: Subject to any disclaimer, the term of this patent is extended or adjusted under 35 U.S.C. 154(b) by 555 days.

(21) Appl. No.: 11/993,133

(22) PCT Filed: Jul. 18, 2006

(86) PCT No.: PCT/IB2006/001963

§ 371 (c)(1),
(2), (4) Date: Dec. 3, 2009

(87) PCT Pub. No.: WO2007/010359

PCT Pub. Date: Jan. 25, 2007

(65) Prior Publication Data

US 2010/0065526 A1 Mar. 18, 2010

(30) Foreign Application Priority Data

Jul. 19, 2005 (IT) ..... BO2005A0483

(51) Int. Cl.
*A61B 19/00* (2006.01)

(52) U.S. Cl. ..... 604/415; 604/407; 604/411; 215/247

(58) Field of Classification Search ..... 215/DIG. 3, 215/249, 327, 247; 604/403, 405, 407, 411, 604/412, 413, 414, 415, 416; 264/268
See application file for complete search history.

(56) References Cited

U.S. PATENT DOCUMENTS

| | | | | |
|---|---|---|---|---|
| 4,574,965 | A | 3/1986 | Meierhoefer | |
| 5,344,417 | A * | 9/1994 | Wadsworth, Jr. | 604/414 |
| 5,429,256 | A * | 7/1995 | Kestenbaum | 215/247 |
| 5,433,330 | A * | 7/1995 | Yatsko et al. | 215/247 |
| 5,740,931 | A * | 4/1998 | Weiler | 215/50 |
| 6,382,442 | B1 * | 5/2002 | Thibault et al. | 215/249 |
| 6,571,971 | B1 * | 6/2003 | Weiler | 215/247 |
| 6,656,433 | B2 * | 12/2003 | Sasso | 422/569 |
| 6,875,205 | B2 * | 4/2005 | Leinsing | 604/414 |
| 7,163,115 | B2 * | 1/2007 | Whitley | 215/276 |
| 2009/0008354 | A1 * | 1/2009 | Weiler et al. | 215/247 |

FOREIGN PATENT DOCUMENTS

DE 102 05 344 A1 9/2002

* cited by examiner

*Primary Examiner* — Mickey Yu
*Assistant Examiner* — Kareen Rush
(74) *Attorney, Agent, or Firm* — Laubscher & Laubscher, P.C.

(57) ABSTRACT

A perforable closure for a container, is provided with at least a annular portion (2) fit to joint the container and connected to an end portion (3), perforable by means of a perforator (P) of an outflow or the like.
At least the annular (2) and end (3) portions of said closure (1) are integral.

9 Claims, 2 Drawing Sheets

FIG.1
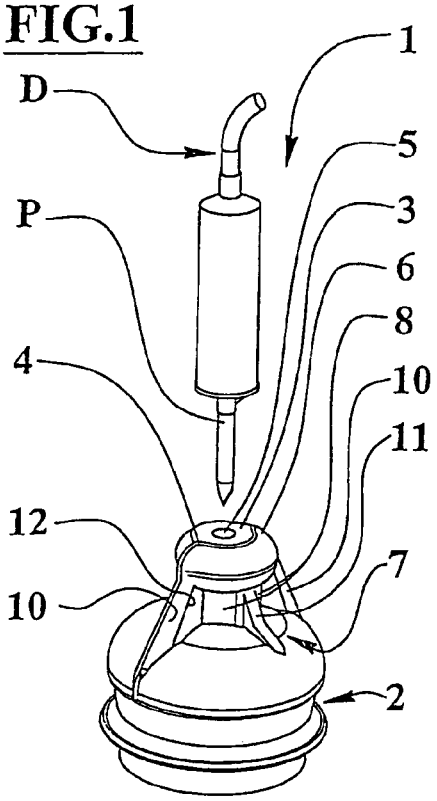
FIG.2
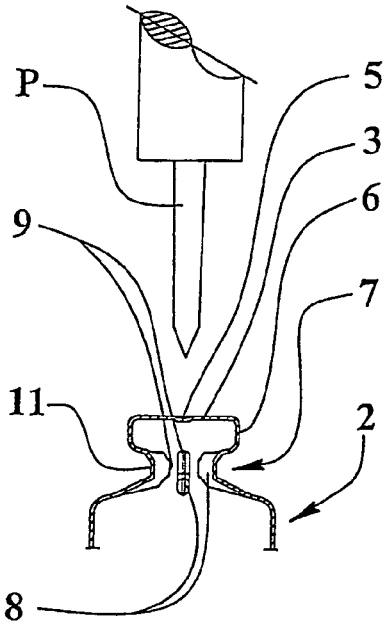
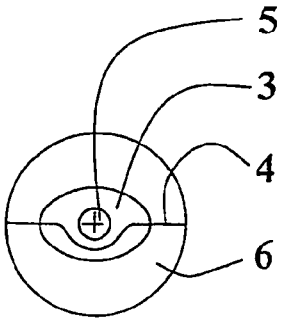
FIG.1B
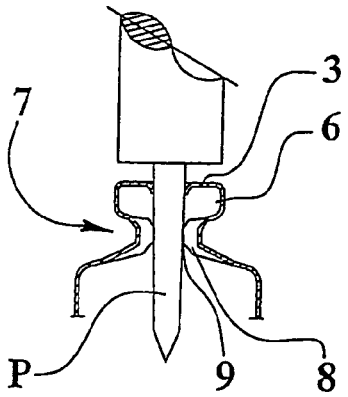
FIG.3

PERFORABLE CLOSURE FOR A CONTAINER, MOULD AND METHOD FOR CARRYING OUT SAID CLOSURE

TECHNICAL FIELD

The present invention relates to the field of the containers and it refers to a perforable closure for a container particularly for a container containing drugs or fluid to give to a human or animal body.

The present invention refers furthermore to a mould and to the method to carry out said closure.

BACKGROUND ART

There are waterproof know closures including a perforable membrane, generally made of synthetic elastic material, applied to the mouthpiece of a bottle by means of a capsule, generally made of aluminium, whose central portion is perforated or removable to allow an operator to connect an outflow for phleboclysis or hypodermoclysis to the bottle perforating it on the membrane by means of a perforator of said outflow.

A drawback of said closures consists in that, being constituted by several elements of different materials, they are difficult to be made and they are expensive.

Further drawback of said known closures consists in that they cannot hold the perforator provoking the risk of accidental detachment of the outflow or the risk of leakage due to excessive inclinations of the perforator.

Further drawback consists in that the interstices between the membrane and the capsule of said known closures can become dirty and/or contaminated and difficult to be cleaned and to be disinfected.

DISCLOSURE OF THE PRESENT INVENTION

An object of the present invention is to propose a simple and economic perforable closure for a container.

Other object is to propose a closure carried out integral and made of a single material.

Further object is to propose a closure able to hold the perforator of the outflow with enough force and to prevent excessive oscillations avoiding the risks of accidental unthreading and dripping.

Other object is to propose a closure without receptacles and easy to be cleaned and to be disinfected in the perforation area.

Further object is to propose a closure applicable to a container, for instance, made of plastic or glass, or carried out integral with the container made of thermo-mouldable plastic.

Other object is to propose a mould and a method to carry out said closure.

BRIEF DESCRIPTION OF THE DRAWINGS

The characteristics of the invention are highlighted in the following with particular reference to the attached drawings, in which:

FIG. 1 shows an axonometric and partial view of the perforable closure object of the present invention and an outflow whose perforator is in proximity of the perforation area of the closure;

FIG. 1B shows a schematic plan view of the end portion of the closure of FIG. 1;

FIG. 2 shows a partial side view of the outflow of FIG. 1 and a view of the closure of FIG. 1 sectioned by an axial plane in a condition prior to perforation;

FIG. 3 shows a partial side and partial sectioned view of the closure and of the outflow of FIG. 1 in a perforated condition;

BEST MODE OF CARRYING OUT THE INVENTION

Figure 5:
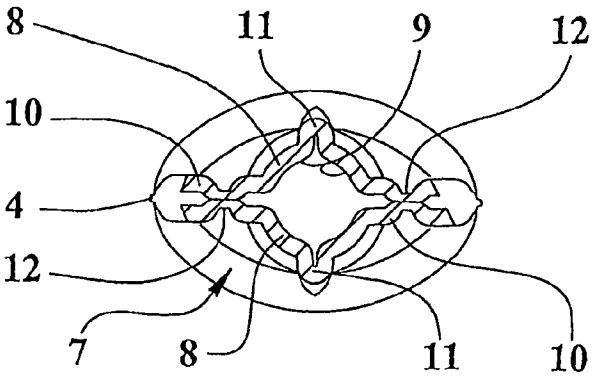
FIG. 5 shows a enlarged view of the closure of FIG. 4 sectioned by the plane V-V.

With reference to FIGS. 1-5 and 1B, numeral 1 indicates the perforable closure for a container object of the present invention.

The closure 1 is equipped with an annular portion 2, for integral forming or for interconnection with the container.

The annular portion 2 is connected, by means of a side portion 7, to an end portion 3 perforable by means of a perforator P of an outflow or the like.

The annular portion 2, the side portion 7 and the end portion 3 are carried out integral and made of thermo-mouldable plastic.

The end portion 3 is nearly flat and without moulding junctions 4 or without irregularity and it is centrally provided with a depression 5 for the friendly positioning of the perforator P. Said perforator P, for instance, consists of a plastic body provided with a slight conicity and with a point in which a duct of the respective outflow flows, for instance of the kind for phleboclysis or similar.

The end portion 3 is made at an end of a hollow end body 6 of the closure 1 having approximately cylindrical shape, spherical, rotation ellipsoid or similar shape and flowing inside the annular portion 2.

The end portion 3 has approximately elliptic, oval, circular or similar shape.

The side portion 7 comprises a plurality of narrowing means 8 protruding inside of the closure and fit to match with the side portion of the perforator P in a penetration condition of this latter in the closure 1.

Each narrowing mean 8 has an internal cylindrical wall portion 9 coaxial to the closure and carried out on the wall of the side portion 7.

The number of the narrowing means 8 is four and they are mutually separated by at least a pair of mutually opposite first ribs 10 and by a pair of second ribs 11 orthogonal to the first ribs 10.

The ribs, first 10 and second 11, extend themselves outward the closure 1 on planes containing the longitudinal axis of said closure 1.

The first ribs 10 are internally hollow and made on the wall of the closure, furthermore, they have side restrictions 12 parallel to their external rectilinear edge. The side restrictions 12 divide the internal volume to each first rib 10 in a first volume almost closed and with elongated shape and in a second volume in communication with the internal volume of the closure.

The second ribs 11 are made in the wall of the closure 1 and are internally hollow or solid.

The first ribs 10 extend from the end body 6, along the side portion 7 up to the annular portion 2 and the second ribs 11 extend along the side portion 7 up to the annular portion 2 or vice versa.

In alternative the invention also provides that the first and second ribs are at least approximately equal.

The first ribs 10 or/and the second ribs 11 confer to the side portion 7 an elasticity sufficient to allow the expansion toward the outside of the narrowing means 8 and to immobilize the perforator P in the perforated condition with a big force.

The moulding junctions 4 of the closure 1 run along the external edge of the first ribs 10 that extend from the end body 6.

The annular portion 2 is predisposed to the seal fixing with the container or, in alternative, is carried out integral with the same container.

The operation of the closure provides that an operator sets the point of the perforator P in the central depression 5 of the end portion 3 and maintaining the perforator approximately aligned to the axis of the closure, acting an axial force causing the breakage of the end portion 3, penetrating the perforator in the closure up to the match of the side wall of the perforator with the inner cylindrical wall portions 9 of the narrowing mean 8 which stop the exit and the oscillation of said perforator with enough force to prevent the accidental unthreading and to prevent the liquid dripping of the container between the end portion of the closure and the perforator.

Figure 7:
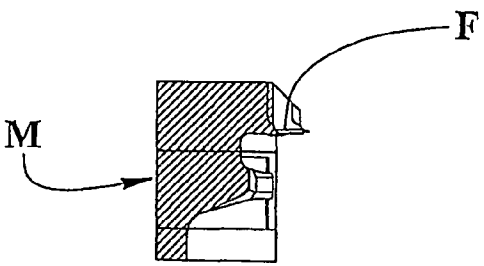
FIG. 7 shows a partial section view of a member of the mould to carry out the closure.
Figure 4:
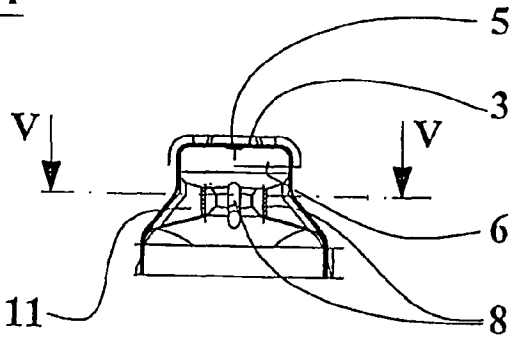
FIG. 4 shows a view of the closure of FIG. 2 sectioned by an axial plane inclined in respect to the section plane of the FIG. 2.
Figure 6:
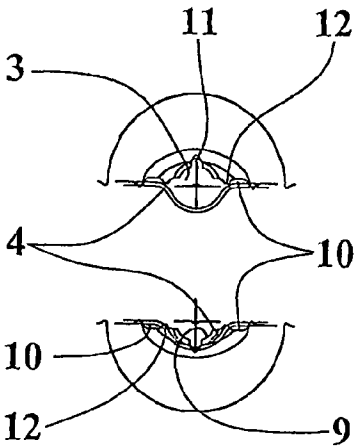
FIG. 6 shows a plan view of the closure of FIG. 1 whose portions carried out by distinct members of a mould, are shown mutually detached.

The mould for carrying out the perforable closure schematized, and divided in its portions of moulding, in FIG. 6 comprises at least two members, one of which, shown in FIG. 7, is equipped with a forming portion F of the whole perforable end portion 3. Besides the two members of the mould, of type for "blow moulding", have respective central and side concave shapes cooperating for the forming of the end body 6 and of the first ribs 10 extending from said end body 6.

The method for carrying out the perforable closure provides to form at least the closure 1 starting from a tubular element made of semi-fluid thermoplastic material so-called "Parison" by means of the blowing technique called "blow moulding."

The method provides also to form the closure and the container integral starting from the same "Parison".

An advantage of the present invention is provide a perforable closure for a simple and economic container.

Other advantage is to provide a closure carried out integral and made of a single material.

Further advantage is to provide a closure able to hold with enough force the perforator of the outflow and to prevent excessive oscillations avoiding the risks of accidental unthreading and dripping.

Other advantage is to provide a closure without receptacles and easy to be cleaned and disinfected in the perforation area.

Further advantage is to provide a closure applicable to a container, for instance made of plastic or glass, or carried out said closure integral with the container made of thermoformable plastic material.

Other advantage is provide a mould and a method to carry out the closure.

The invention claimed is:

1. A perforable closure for a container, comprising (a) a lower annular portion for connecting the closure externally with an upper end of the container;

(b) a generally flat and uninterrupted upper end portion perforable by a perforator when the perforator is inserted into the closure for delivering fluid from the container; and (c) an elastic intermediate wall portion between said lower and upper portions, said lower annular, intermediate wall and upper end portions being coaxially arranged and integral to form a unitary closure, said intermediate wall portion having a cylindrical inner wall having a diameter less than the diameters of said annular and upper end portions, said intermediate wall portion including a first pair of ribs and a second pair of opposed ribs spaced from and orthogonal to said first pair of ribs, said first and second pairs of ribs extending outwardly with respect to the closure intermediate wall portion within planes extending through a longitudinal axis of the closure, said inner wall portion guiding said perforator as it is inserted into the closure with said intermediate wall portion expanding outwardly and said ribs providing a gripping force for ripping the perforator when the perforator is inserted into the closure.

2. A closure as defined in claim 1, wherein said upper end portion contains a depression in a central region thereof for receiving an end of the perforator.

3. A closure as defined in claim 2, wherein said end portion has one of an elliptical, oval, and a circular shape.

4. A closure as defined in claim 1, wherein the closure is connected with the container in a sealing relation.

5. A closure as defined in claim 1, wherein the closure is integral with the container.

6. A method for forming a closure as defined in claim 1, comprising the step of blow molding a parison of semi-fluid thermo-plastic material.

7. A method as defined in claim 6, wherein the closure and container are blow molded from the same parison to form an integral structure.

8. A perforable closure for a container, comprising (a) a lower annular portion for connecting the closure externally with an upper end of the container;

(b) a generally flat and uninterrupted upper end portion perforable by a perforator when the perforator is inserted into the closure for delivering fluid from the container; and (c) an elastic intermediate wall portion between said lower and upper portions, said lower annular, intermediate wall and upper end portions being coaxially arranged and integral to form a unitary closure, said intermediate wall portion having a cylindrical inner wall having a diameter less than the diameters of said annular and upper end portions, said intermediate wall portion including a first pair of ribs and a second pair of opposed ribs spaced from and orthogonal to said first pair of ribs, said first and second pairs of ribs extending outwardly with respect to the closure intermediate wall portion within planes extending through a longitudinal axis of the closure and at least one of said first and second pairs of ribs extending continuously between said upper end portion and said lower annular portion, said closure containing a seam extending through said upper end portion, along an external edge of said first pair of ribs, and through said lower annular portion, said inner wall portion guiding said perforator as it is inserted into the closure.

9. A closure as defined in claim 8, wherein said first pair of ribs contains side restrictions parallel to the external edge thereof.

* * * * *